United States Patent [19]

Loegel et al.

[11] Patent Number: 4,960,176

[45] Date of Patent: Oct. 2, 1990

[54] DEVICE FOR CUTTING, DRILLING OR SIMILAR WORKING OF ROCK, ORE, CONCRETE OR THE LIKE

[75] Inventors: Charles Loegel, Lichtenberg; Isabelle Durr; Sylvie Reichert, both of Ingwiller; Patrick Loegel, Lichtenberg; Francine Schneider, Ingwiller, all of France

[73] Assignee: CIWJ Compagnie Internationale du Water Jet, France

[21] Appl. No.: 411,531

[22] PCT Filed: Jul. 5, 1988

[86] PCT No.: PCT/EP88/00593

§ 371 Date: Sep. 29, 1989

§ 102(e) Date: Sep. 29, 1989

[87] PCT Pub. No.: WO89/01396

PCT Pub. Date: Feb. 23, 1989

[30] Foreign Application Priority Data

Aug. 11, 1987 [DE] Fed. Rep. of Germany ..... 3726733
Nov. 24, 1987 [DE] Fed. Rep. of Germany ..... 3739825

[51] Int. Cl.[5] ..... E21B 7/18; E21C 25/60

[52] U.S. Cl. ..... 175/424; 175/231

[58] Field of Search ..... 299/17; 175/67, 231, 175/393, 424; 239/227, 229, 264

[56] References Cited

U.S. PATENT DOCUMENTS

| | | | |
|---|---|---|---|
| 671,429 | 4/1901 | Bacon | 175/424 X |
| 3,199,615 | 8/1965 | Storm | 175/231 X |
| 4,369,850 | 7/1988 | Barker | 175/393 |

*Primary Examiner*—William P. Neuder

[57] ABSTRACT

To cut, bore or similarly machine rock, ore, stratified coal or other objects, a medium is delivered under high pressure through a supply pipe to a nozzle. The supply pipe is designed as a pendulum-type pipe, in particular in the form of a flexible high-pressure hose, and executes, together with the nozzle, rapid, for example oscillating and/or circular, movements along a guide. In this way, straight cuts and/or holes can be made very rapidly and simple in rock. The cut width can be controlled by the arrangement and fitting in particular of a plurality of nozzles, depending on the rock and pressure medium. In particular, an eccentric element which functions as a drive mechanism permits a circular movement of the nozzle.

24 Claims, 7 Drawing Sheets

Fig. 1
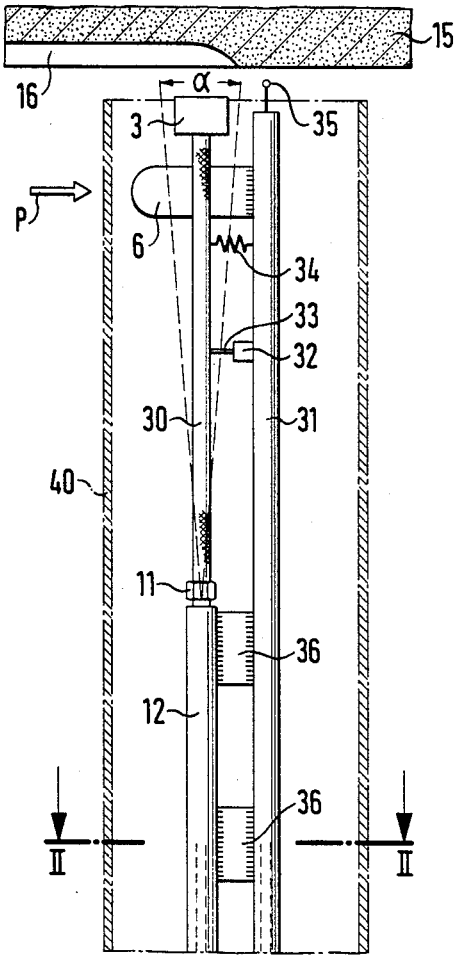
Fig. 3
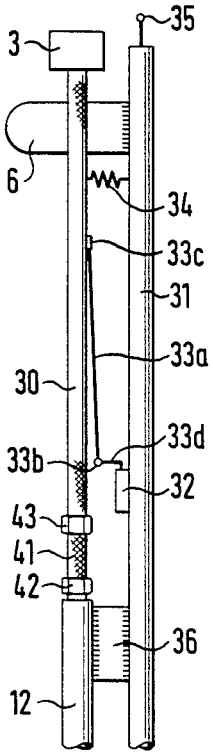
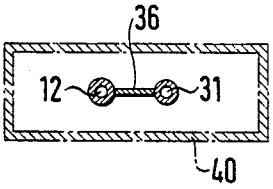
Fig. 2

Fig. 9
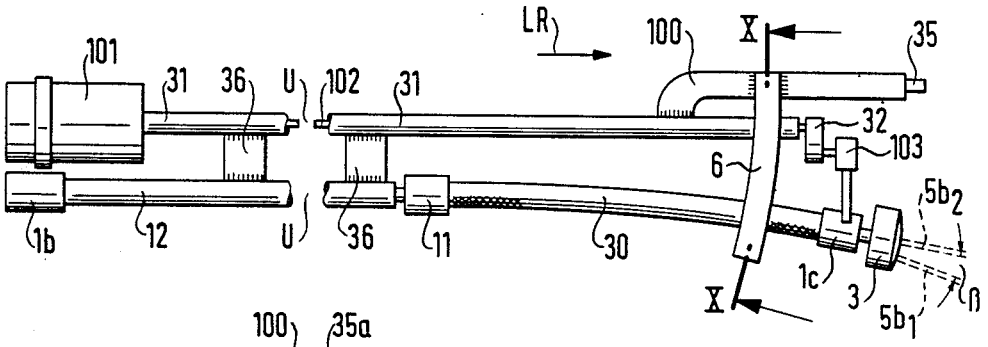
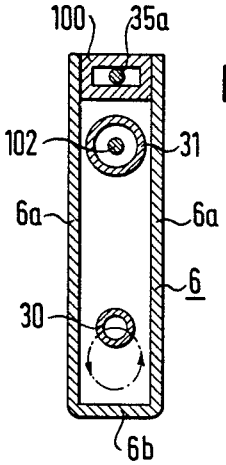
Fig. 10
Fig. 12
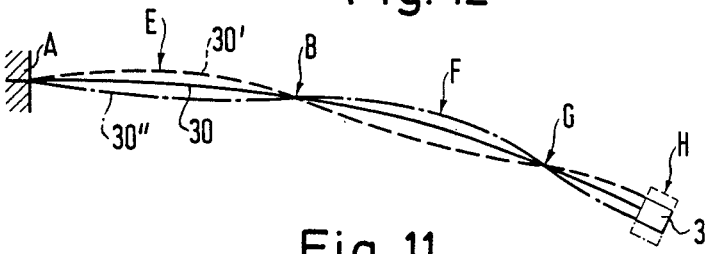
Fig. 11
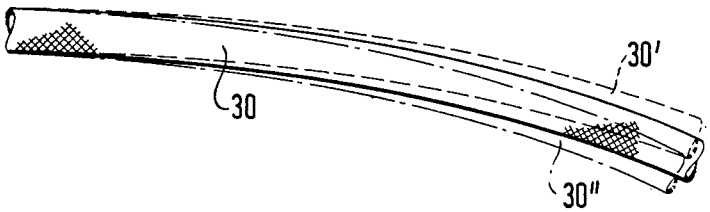

DEVICE FOR CUTTING, DRILLING OR SIMILAR WORKING OF ROCK, ORE, CONCRETE OR THE LIKE

DESCRIPTION TECHNICAL FIELD

The invention is directed to a device particularly for cutting and drilling of rock, ore, natural stone, concrete or the like or for treating objects by means of a high-pressure medium, as specified in the preamble of patent claim 1.

BACKGROUND ART

Such a device has already been known (GB-PS No. 1,460,711). In this device, a nozzle head is deflected to oscillate by means of a drive mechanism transversely to the direction of the jet of pressure medium ejected from a nozzle orifice. The drive mechanisms used therein are ultrasonic transducers, electro-mechanical transducers and also mechanically or hydraulically driven mechanisms. The nozzle had itself is supported in bearings so that it is either movable linearly or pivotable about a bearing journal. It has been found, however, that this kind of bearing is subject to rapid wear when operating with oscillatory movements of relatively high frequency, as is recommended for efficient cutting.

The same problems arise with a further known device (GB-PS No. 2,027,776) in which likewise a nozzle head including a cam is reciprocable on a linear guide path of a bearing unless a bearing journal is also used for bearing purposes. This device is used for knocking concrete off reinforcement system or for removing a flooring by means of a liquid jet.

It is furthermore known (DE-OS No. 3,516,572) to provide a nozzle head, which is mounted on a flexible high-pressure hose, with a plurality of nozzles screwed into the end face of the nozzle head. A central nozzle extends in axial direction of the nozzle head while on either side of the central nozzle two further nozzles are provided with their nozzle axes inclined relative to the axis of the nozzle head. This nozzle head has already been found satisfactory for rock cutting.

SUMMARY OF THE INVENTION

Finally it has been known (DE-OS No. 2,607,097) to mount a nozzle head provided with a nozzle on a tube which is pivotable about a swivel bearing, wherein the end of the tube remote from the nozzle head is movable on a circular path in a plane extending transversely to the tube axis by means of an eccentric member such as a crank mechanism.

It is the object of the invention to improve the device of the above-specified kind in respect of its operability. Above all, it is desirable to provide relatively narrow devices with which it is also possible to work in elongated and narrow slits, bores and similar openings, for instance in rock. Typically, the device should be intended for prolonged use. Furthermore, the operability of the nozzle head shall be improved with little manufacturing effort and little space requirement. It is desirable to achieve rapid cutting, for instance slit-like quarrying of rock, seams and the like, especially also of very hard materials such as granite and marble.

The invention is characterized in claim 1, in which at least a portion of the supply pipe is designed as a rocking pipe which is engaged by the drive mechanism, for instance, by way of a coupling means. In this connection "rocking pipe" is intended in particular to mean a supply portion to the nozzle head which supply portion upon operation moves in a way to cause the nozzle head to perform a reciprocating or circular or even oval movement, especially in a plane which extends substantially at right angles to the axis of the nozzle or the central nozzle, respectively.

This rocking or "pendulum" motion, as viewed from the side, deflects the jet laterally. On account of the "rocking" or swinging motion the jet describes a straight or arcuate line upon striking the object to be cut (provided a striking point is assumed and an otherwise static position of the device with the exception of the "rocking" supply portion is also assumed).

The drive mechanism is supported by a control pipe which extends substantially in parallel to the supply pipe.

The control pipe conducts the energy carrier for energizing the drive mechanism, for instance mechanical rotary motions, i.e. kinetic energy, to the drive mechanism and comprises guide means for the rocking pipe which guide means may be formed by the drive mechanism itself.

The rocking pipe itself may be relatively rigid and is coupled to the supply portion especially via a flexible and/or pivotable coupling. Advantageously, the rocking pipe is additionally connected to the control pipe by way of one or several springs so that the driving energy is transmitted from the drive mechanism via the spring into even stronger oscillating motions. But it will also be possible to employ a rocking pipe which, though pliable, still has sufficient inherent stiffness so that the nozzle head is sufficiently supported and guided by the rocking pipe itself. The last-mentioned alternative is even preferred; in this case the nozzle head is mounted on the free end of a flexible high-pressure hose which can be somewhat expanded under internal pressure.

In accordance with a particular embodiment of the invention, the nozzle head comprises plural nozzles disposed at different angles such that their axes are not disposed in a common straight plane. The nozzle axes should be offset with respect to the longitudinal axis of the nozzle head. In this embodiment of the invention, the nozzle head emits a combined jet of pressurized medium whose discrete jets which are emitted from the individual nozzles do not extend in a straight plane like a fan, as is the case with the initially mentioned device, but extend in one or several curved and/or bent planes. By proper selection of the number and arrangement of the setting angles or the nozzle axes, respectively, a more rapid and more accurate control of the "cutting width" in rock, seam, ore veins, concrete or the like can be achieved. This embodiment is especially suitable when other than straight cuts are also to be made in rock.

Particular advantages can be achieved with a nozzle head comprising a central nozzle and respective side nozzles each being laterally offset and outwardly inclined away from the direction of the jet from the central nozzle. When the nozzle head is moved on a circular path, for example, the individual jets also will describe circular paths which overlap partially, whereby during a transverse movement of the device transversely of the rocking pipe or the high-pressure hose and the control pipe a slit-like contour can be cut even better into the treated rock.

In accordance with a special embodiment of the invention, nozzles are not screwed into the end face of the nozzle head. Rather, the end face of the nozzle head is provided with an elastomeric cover and insertion nozzles are fitted by way of a nozzle chamber into communicating passages of the nozzle head, which is especially made from a cutting metal. The pressurized medium necessarily urges the respective insertion nozzles against abutments which define the communicating passages and form transistions to the nozzles. It is unnecessary to provide either the insertion nozzles or the receptacles therefor in the nozzle head with screw threads so that it is also possible to employ sapphire nozzles.

The embodiment of the nozzle head according to the invention can be used with the apparatus according to the invention comprising a rocking pipe and especially a control pipe extending in parallel thereto, but it can also be used with an already known apparatus (DE-OS No. 3,410,981), in which a pliable high-pressure hose functions as a supply line to the nozzle head which is either caused by the ejected pressure medium itself - without any drive mechanism - to perform whiplash motions or which is caused by a combination of a driving force created by the flow of pressure medium itself and by a drive mechanism to additionally perform gyrating, pulsating and/or wave-like motions. The wave-like motion of the high-pressure hose (in a plane extending through the hose axis) is highly conducive to this effect.

DESCRIPTION OF THE DRAWINGS

Embodiments of the invention will be described below with reference to the drawing, in which:

FIG. 1 is a schematic illustration of a device according to the invention;

FIG. 2 is a schematic sectional view along the line II—IIA of FIG. 1;

FIG. 3 is a schematic elevation according to FIG. 1 illustrating another embodiment of the device;

FIG. 9 is a partial view of a further embodiment of the device;

FIG. 10 is an enlarged section along the line X—X of FIG. 9;

FIG. 11 is an enlarged portion of FIG. 9;

FIG. 12 is a schematic diagram showing oscillations of the high-pressure hose;

DETAILED DESCRIPTION

Figure 4:
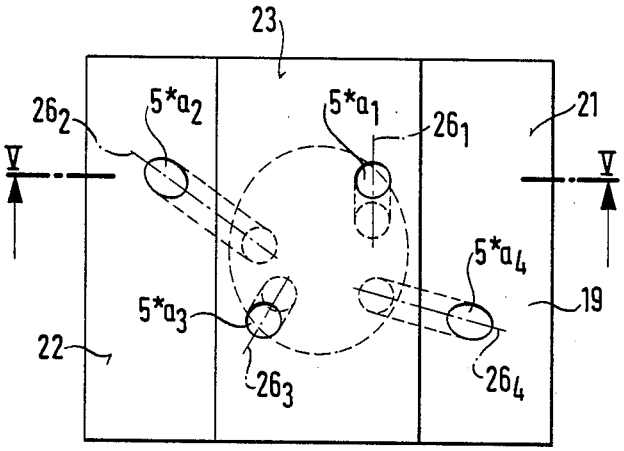
FIG. 4 is a front view of a nozzle head.

As shown in FIG. 1, a pipe serving as pressure medium supply pipe 12 is rigidly joined through connecting webs 36 to the control line 31 likewise constituted by a pipe; the pipe 12 and the control pipe 31 extend in parallel. The free end of the pipe 12 has a union 11 mounted thereon for coupling the rocking pipe 30 with the pipe 12 in such a way that the rocking pipe 30 can be caused to perform rocking motions about the coupling location of the union 11—as indicated by dashed lines—for instance about the traversing angle $\alpha$. Instead of the union 11 it is also possible, for instance as shown in FIG. 3, to mount a high-pressure hose between pipe 12 and rocking pipe 30 so that the pressure medium flows through the pliable high-pressure hose, which does not prevent the rocking motion of the rocking pipe 30 in operation.

The rocking pipe 30 is supported on the guide member 6 which projects laterally from the control pipe 31. The free end of the rocking pipe 30 has a nozzle head 3 the front of which is provided with at least one nozzle through which in operation high-pressure medium can be ejected towards the rock 15. The rocking or oscillating motion to right and left about the traversing angle $\alpha$ of the rocking pipe 30 and thus also of the nozzle head 3 mounted thereon is caused by a drive mechanism 32 which is mounted on the control pipe 21 and is adapted to be driven by an energy carrier such as kinetic, electric, electromagnetic, pneumatic or hydraulic energy, which is delivered via the control pipe 31 to the drive mechanism 32. A plunger 33 of the drive mechanism 32 briefly pushes the rocking pipe 30 in the direction away from the control line 31. Thereby a spring 34 is stretched which spring prevents excessive deflection of the rocking pipe 30 on the one hand and pulls the rocking pipe 30 back in the opposite direction, i.e. towards the control pipe 31, on the other hand.

By the combined interaction of the drive mechanism 32 and the spring 34 with the rocking pipe 30, the latter rocks about the traversing angle $\alpha$, so that the jet of pressure medium, which is not illustrated in FIG. 1, oscillatingly strikes the rock 15 according to the angle $\alpha$ and cuts a slot-like cut 16 into the rock as the device is guided as indicated by the arrow P along the front of the rock 15.

The free end of the control pipe 31 is provided with a sensor 35 for detecting especially the depth and the width of the cut 16 or the distance from the front of the rock 15. It would be advantageous to provide the rocking pipe 30 with a sufficient length intermediate the union 11 and the nozzle head 3 so that even by very slight deflection due to the plunger 33 of the drive mechanism 32 sufficiently wide deflections are caused at the nozzle head 3, because thereby the efficiency of the pressure medium upon impacting the rock 15 is improved. To this end, it would also be advantageous that the drive mechanism 32 engages the rocking pipe 30 at a location which is much nearer the union 11 than the spring 34. The sensor 35 preferably is an electric sensor whose electric signal wires are led through the control pipe 31 to a control unit, which is not illustrated.

To protect the tubular bodies comprising the rocking pipe 30 the control pipe and the drive mechanism it is advantageous to provide a casing thereabout as indicated by the dash-dot lines 40.

In the alternative embodiment shown in FIG. 3, the drive mechanism 32 is disposed relatively close to the union 11. A driving rod **33*a* constitutes a relatively long arm between the free end 33*c* pressed against the rocking pipe 30 and a pivot axis 33*b* about which the driving rod 33*a* is pivotable together with the operating arm 33*d*, which is integrally joined therewith and is offset by about 90°, when the latter is driven for some distance by the drive mechanism 32 in a direction substantially parallel to the control pipe 31 (in counterclockwise direction). Since the operating arm 33***d* is shorter than the driving rod 33*a* by a multiple, especially by more than four times, a mere slight movement of the free end of the operating arm 33*d* in axial direction of the control pipe 31 will result in a substantially greater movement of the free end 33*c* of the driving rod 33*a* traversely to said axial direction. In order to avoid, at high pressures of e.g. 2000 bar of the pressure medium passed from the pipe 12 to the nozzle head 3, any restriction of the rocking motion of the rocking pipe 30 due to the union 11 acting as a rocking pivot possibly becoming too rigid, it would be advantageous to direct the pressure medium through a flexible high-pressure tube acting as a connecting conduit 41 from the pipe 12 to the rocking pipe 30. The connecting conduit 41 constitutes a union. It is led out of the pipe 12 and into the rocking pipe 30 through conduit coupling sleeves 42 and 43.

Figure 5:
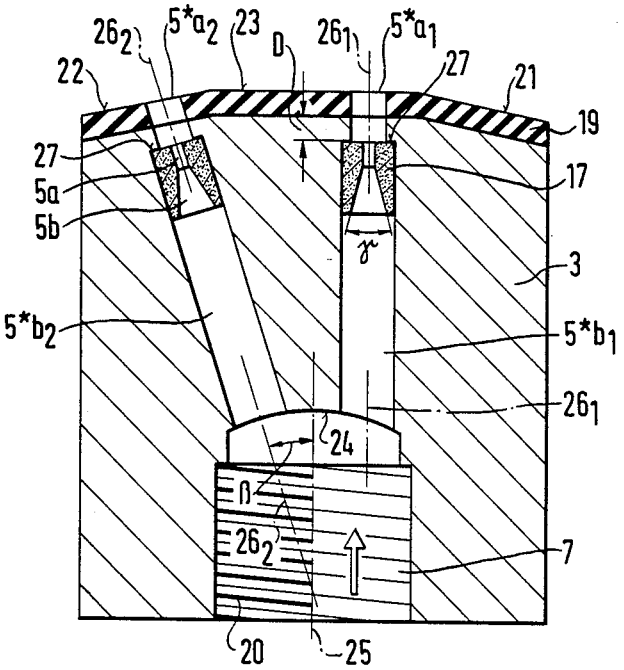
FIG. 5 is a partial section along the line V—V through the nozzle head of FIG. 4.

As illustrated in the plan view of FIG. 4, the nozzle head 3 is substantially rectangular, but it may also be substantially cylindrical. In the present embodiment the nozzle head of FIG. 5 is provided on the outer or front face with an elastomeric cover 19 made of rubber which extends across the two outwardly inclined front faces 21, 22 and also across the central end face 23, which extends at right angles to the axis 25 of the nozzle head 3 which is made from hard metal.

Figure 8:
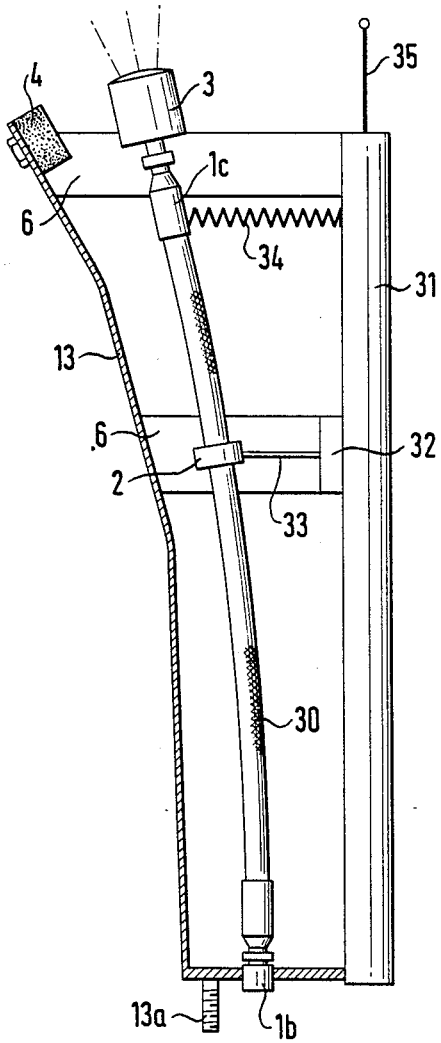
FIG. 8 is a partial sectional view of another embodiment of the device.
Figure 13:
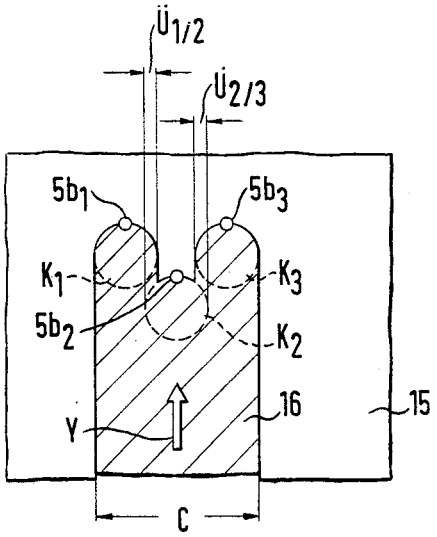
FIG. 13 is a schematic view illustrating the formation of channels in rock.

The other side of the nozzle head 3 is provided with the chamber, the annular side face of which contains a fitting 20 by means of which the nozzle head 3 can be threaded onto the union member 1*c* of the rocking pipe 30 shown in FIG. 8. When pressurized medium flows through the rocking pipe 30 into the chamber 7, the medium presses the cylindrical insertion nozzles 17, made from sapphire against the ends of the communicating passages 5**b* which communicate the chamber 7 via the cylindrical nozzles 5*a* and the nozzle cones 17*b* to the nozzle outlets 5**a* which are outwardly expanded relative to the axis 25 of the nozzle head. The diameter of the nozzle outlets 5**a* is smaller than the diameter of the communicating passages 5**b* so that abutments or shoulders 27 for the insertion nozzles 17 are formed. On the other hand, the diameters of the nozzles 5*a* are substantially smaller than the diameters of the nozzle outlets 5**a*. The nozzle cones 5*b* open from nozzle cylindrical openings 5*a* towards the nozzle chamber 7. The insertion nozzles 17 are as close as possible to the end face in the vicinity of the cover 19 of the nozzle head 3, i.e. the distance D between the shoulders 27 and the interface between the hard metal body of the nozzle head 3 and the cover 19 is selected to be just sufficient to exclude the risk of breaking-out at high medium pressures.

In the illustrated embodiment, the two nozzle outlets 5$a_1$ and 5**$a_3$ terminate at the planar end face 23 whereas the two nozzles 5**$a_2$ and 5**$a_4$ terminate at one of the inclined front faces 21 and 22, respectively. The axes 26 of the communicating passages 5****b* and thus of the nozzles 5*a* extend at set angles $\beta$ relative to the nozzle axis 25. FIG. 4 shows clearly that the axis 26$_1$ is also inclined relative to the axis 25 of the nozzle head 3, which would not readily be expected from a study of FIG. 5.

While the pressure medium is still compressed towards the nozzles 5*a* via the nozzle cones 5*b*, which extend at the spread angle $\gamma$, the pressure medium which is especially water expands thereafter at first behind the region of the nozzles 5*a* and thereupon outside of the nozzle head 3 and its cover 19. In contrast to FIGS. 6/7, each discrete jet should remain "compact" as far as possible, i.e. it should diverge but little. Therefore the nozzle head 3 is guided very close to the rock, for example to within a distance of a few centimetres.

Figure 6:
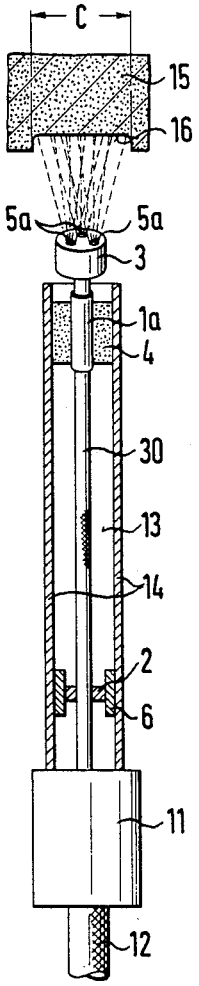
FIG. 6 is a partially broken-away plan view illustrating an embodiment of the nozzle head in operation.
Figure 7:
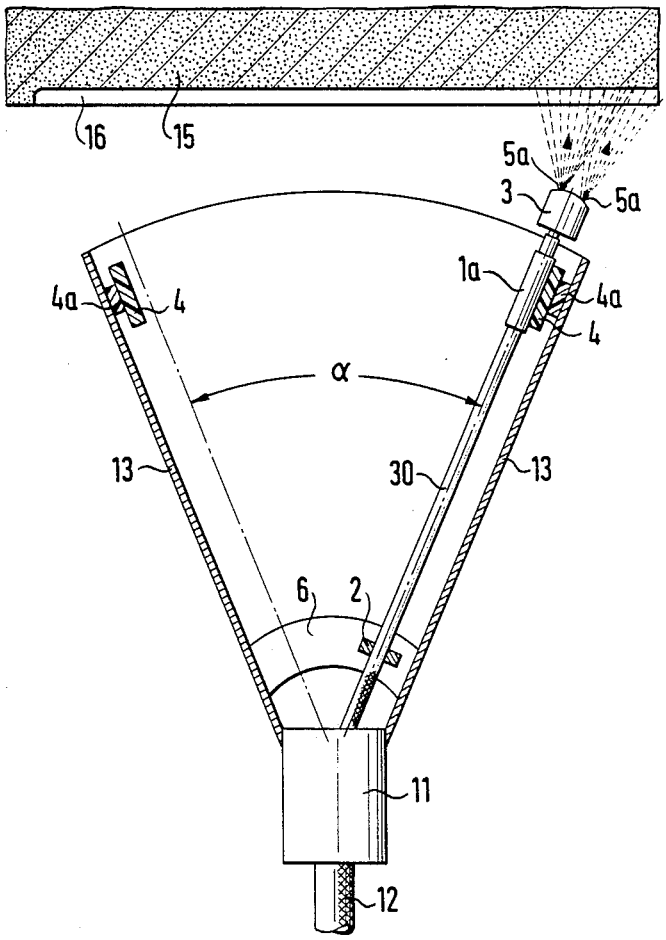
FIG. 7 is a side view of the device according to FIG. 6 in partial section.

In another embodiment illustrated in FIGS. 6 and 7, when the device is operated, the pressure medium passes in the direction of the arrows from the rocking pipe 30 into the chamber 7 and exits from the nozzles 5*a* in the nozzle head 3. Starting at a pressure of about 250 bar, the rockingly mounted nozzle head 3 continues to oscillate between the abutments 4 at a greater or lesser rate even without a separate driving mechanism, so that a "cutting" effect on the rock 15 or the like is achieved without any contact between the nozzle head 3 and the rock 15.

The device comprises as a supply pipe a rocking pipe 30, in the instant case a high pressure hose which may be flexed resiliently, with a nozzle head 3 and nozzles 5*a* on the end face and with guide means 6 including abutments 4 and springs in the form of resilient cushions 4*a*. In order to avoid excessive wear of the rocking pipe 30 during operation of the device, the rocking pipe 30 preferably comprises a guide member 2 which together with the nozzle head 3 and in cooperation with the guide means 6 results in a striking motion or high-frequency rocking motion or oscillation of the rocking pipe 30 and the nozzle head 3 between the abutments 4 in accordance with the traversing angle $\alpha$. In the vicinity of the abutments 4, the rocking pipe 30 is preferably provided with reinforcing sleeves.

As illustrated in FIGS. 4 and 5, the nozzles 5*a* of the nozzle head 3 are disposed at different setting angles relative to the longitudinal axis 25 of the nozzle head 3. The cutting width C (FIG. 6) may be adjusted so that the guide means 6 with the walls 14 mounting the same can follow the cut 16. The rocking pipe 30 oscillates about the union 11 with the pressure medium supply pipe 12. As in the case of FIGS. 1 to 3, the rocking pipe 30 may also be a rigid pipe provided it performs the desired rocking motion, but a certain elasticity for achieving "whiplash" motions would be more advantageous.

The abutments 4 may themselves be made from a resilient material such as rubber. These abutments 4 permit a prolonged life as compared to an embodiment which does not comprise such abutments 4.

The guide means 6 may bear against the walls 14 which are interconnected by straight (FIG. 7) or arcuate (FIG. 8) end walls 13, but it may also have different configurations, for example a mesh-like reinforcement through which the material removed by the cutting operation may be discharged together with the medium. The guide means 6 may be secured by bolts 13*a*.

It would be appropriate to minimize the weight of the rocking pipe 30 including the nozzle head 3, which constitute an integral assembly capable of oscillating about the union 11, so that a high oscillating frequency with a low moment of inertia is possible; frictional forces on the guide means 6 should be low.

It is possible with the device to make cuts 16 at practically any desired depth while the small device of minimum bulk follows into the rock 15 without subjecting the rock to strong vibrations which might lead to the formation of cracks and could result in an increased rate of rejection on subsequent finishing.

With reference to the FIGS. 9 to 13 an especially preferred embodiment of the invention will be described in detail below.

As shown in FIG. 9, the elongated assembly, which is merely illustrated with interruptions U while it is actually of continuous length, is composed among others from the following parts:

The pressure medium supply pipe 12 is a straight steel pipe and extends from the joint 1*b* for connection of a pressure-medium conduit right to the union 11 in parallel relationship with the control pipe 31 which is likewise a steel pipe, the two pipes being joined by welding through the connecting webs 36. Inside the steel tube of the control pipe 31, a rotary shaft 102 is supported which at its left-hand end in FIG. 9 is adapted to be driven by an hydraulic motor 101 while the other end protruding from the free end of the control pipe 31 is connected to an eccentric member, used as driving mechanism 32. When the shaft 102 rotates about its axis, the coupling element 103 is moved on an orbit by the eccentric member that acts like a crank; it will also drive along the fitting member 1*c* at the free end of the flexible rocking pipe 30 in the form of a high-pressure hose, which is even inflatable, i.e. flexible to some extent, so that the nozzle head 3 detachably screwed to the fitting member 1*c* will perform a circular motion along with the rotation of the shaft 102. The jets $5b_1$, $5b_2$ of pressure medium emitted from the nozzle head 3 will describe corresponding circular paths as will be explained in detail with reference to FIG. 13. The motor 101 is adapted to drive the shaft 102 and hence also the nozzle head at a frequency of from 1500 to 10,000 r.p.m., i.e. between 25 and approx. 167 Hz.

In FIG. 10, which is a partial sectional view X—X of FIG. 9, legs 6*a* of a U-shaped guide member 6 extend on either side of the control pipe 31 including the shaft 102 supported therein. The two legs 6*a* are joined by a web 6*b* at their lower ends, so that the circular or oval path of movement of the high-pressure hose, which is used as rocking pipe 30, can additionally be guided. The free ends of the legs 6*a* are welded to the sides of the connecting piece 100 which accommodates the sensor 35 and a lead wire 35*a* leading to the same. The sensor 35 may be movable in longitudinal direction of the connecting piece 100 so as to actuate a contact when striking a surface. However, the sensor 35 may also be rigidly connected to the mandrel-like connecting piece 100; in any case the sensor 35 should project beyond the nozzle head 3 in longitudinal direction LR of the lance-like elongated device so that the nozzle head is protected on its front face from striking solid objects. The guide member 6, which encloses the approximately circularly "oscillating" high-pressure hose 30, should leave such a free space between the facing sides of the legs 6*a* that the high-pressure hose 30 is not obstructed in its movement which is caused by the drive member 32 designed as eccentric member. Surprisingly, it has been found that the high-pressure hose on account of its pliable and even slightly flexible design due to the use of elastomeric material, such as rubber, which even permits a certain degree of inflation when the pressure medium is passed therethrough, is caused to perform oscillations of the type schematically illustrated in FIG. 12. At the fixing position A, for example, which corresponds to the union 11 of FIG. 9, the high-pressure hose 30 may be in a stationary state while at the extreme end D, where the nozzle head 3 is secured, it performs an oscillating movement which is a reciprocating movement in the drawing plane but which actually—as will be explained with reference to FIG. 13—is a circular movement in a plane which is practically perpendicular or normal or at an angle of 90° to the nozzle axis. In contrast to the situation schematically illustrated in FIG. 11, in which merely the outer end of the high-pressure hose 30 facing the nozzle head 3 is moved about an imaginary center in the circular path and adopts various positions, such as the full-line as well as the dashed-line (30') and the dash-dot-line positions (30''), there actually result antinodal points E and F as well as nodal points B and C. This "wave-like" hose movement is not undesirable, however, but surprisingly it is even especially advantageous in view of achieving a good rock treating or rock removing rate. On the other hand, excessive deflection of the hose, i.e. excessive amplitudes of oscillations at the antinodal points E, F should be prevented by the guide member 6. Therefore the guide member as well as the drive member 32 designed as eccentric member with its coupling 103 to the high-pressure hose, in conjunction with the material of the high-pressure hose and the pressure of the medium passing therethrough, can be used to control the mentioned removal rate.

It is advantageous to utilize a maximum pressure of the medium. Suitable pressures are between 1500 and 2500 bar.

Also, the configuration of the nozzle head 3 is a means for adjusting optimum conditions in conjunction with the movement of the nozzle head 3 and in dependence on the object to be treated or cut.

Thus, it would be advisable in accordance with a special embodiment of the invention to provide the nozzle head 3 with a central nozzle and with two side nozzles. The central nozzle directs a central jet $5b_2$ in longitudinal or axial direction of the nozzle head 3, while the side jets $5b_1$, $5b_3$ are offset relative thereto by a setting angle $\beta$ of about 20°. Each of the jets $5b_1$, $5b_2$ and $5b_3$ impacts substantially point-like on the surface of the rock 15 or the already formed channel-like "cut" 16. As the nozzle head 3 is performing the mentioned circular movement, these points of impact of the jets $5b_1$, $5b_2$ and $5b_3$ are also guided according to the non-continuous circles $K_1$, $K_2$ and $K_3$ of FIG. 13 at a frequency between about 25 and 167 Hz, so that the material of the rock 15 is practically knocked out, so that the channel 16 is cut out of the rock 15 in accordance with the width C of the overall area on which the jets impact. It is favourable that in the course of the advance of the device in the direction of the arrow Y of FIG. 13 there result areas of overlap $\ddot{U}\ \frac{1}{2}$ and $\ddot{U}\ \frac{2}{3}$ between adjacent circles $K_1/K_2$, on the one hand, and $K_2/K_3$, on the other hand, while no such overlaps occur in the marginal regions, i.e. at the edges of the channel 16. With a distance of about 1 to 2 cm between the front end of the nozzle head 3 and the area of the rock 15 to be impacted by the jets $5b_1$, $5b_2$ and $5b_3$, and with the use of these three nozzles it is possible with a pressure of 2000 bar of the medium and a frequency of 50 Hz to achieve a removal rate of 15 $m^2/h$ for sandstone and an unexpectedly high removal rate of 3 $m^2/h$ for granite. The central jet $5b_2$ has a flow rate of 8 l/min and the side jets $5b_1$, $5b_3$ have a higher flow rate of 14 l/min of the pressure medium, which is water. Surprisingly, it has been found that this high removal rate is possible only with such a flexible high-pressure hose serving as rocking pipe 30 and as connecting member between nozzle head 3 and the substantially rigid supply pipe 12 while using the eccentric member as a drive mechanism 32. It is evident that there occurs a super-position of motions which are caused by the eccentric member, on the one hand, and by the pliable and flexible nature of the high-pressure hose and finally even by pulsations of the pressure medium itself caused by the high-pressure pump (not illustrated), on the other hand.

Figure 14:
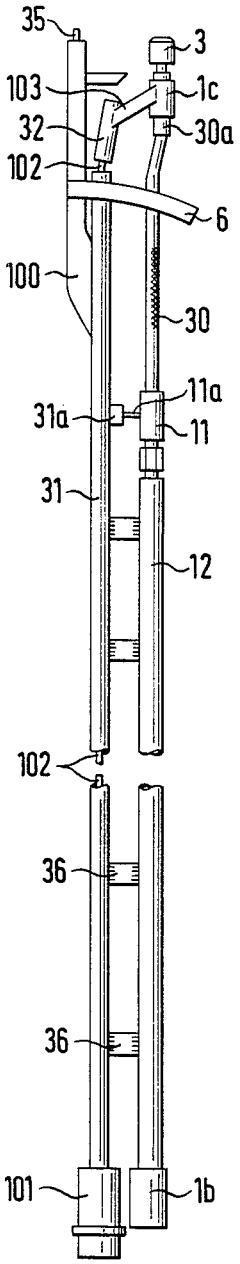
FIG. 14 is a schematic partial view of an alternative embodiment of the device illustrated in FIG. 9.
Figure 15:
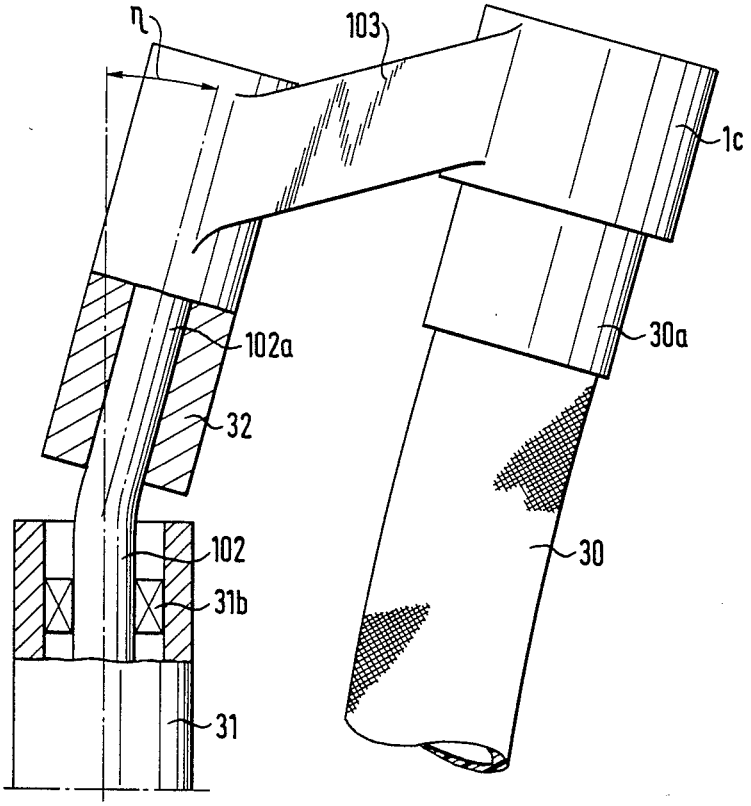
FIG. 15 is a detailed view (partially broken) of a portion of the device of FIG. 14.

An alternative to the device of FIG. 9 is illustrated in FIGS. 14 and 15. Here, the eccentric member or drive mechanism 32 is not a crank member but is constituted by the shaft end 102*a*, which is bent at an angle of (n) of 10–25° to the longitudinal axis of the shaft 102 and on which a sleeve serving as eccentric member or drive mechanism 32 is fitted and secured. This sleeve is firmly connected to the connecting piece 1*c* via a rigid arm, used as coupling member 103, said connecting piece 1*c* being provided at the end of the high-pressure hose 30 and being securely mounted thereon by means of a union socket 30*a*. The nozzle head 3 is not illustrated in FIG. 15. The shaft 102 is mounted on the end of the control pipe 31 by means of a bearing 31*b* so that the shaft end 102*a* rotates about the rotational axis defined by the bearing 31*b* and due to the angle $\eta$ imparts an oscillation motion also to the connecting piece 1*c* and the nozzle head 3.

On the union 11 a radially projecting arm 11i a is nonrotationally mounted for abutting a stop member 31*a* provided on the control pipe 31 whereby it prevents the screw threads of the union 11 from loosening or even accidentally coming away during the oscillating or rocking motions of the high-pressure hose 30.

In the invention, the arrangement of the connecting piece 1*c* to the eccentric member also offers further possibilities of variation. When another section of a pliable high-pressure hose 30 is mounted as an "additional" rocking pipe between the connecting piece 1*c* and the nozzle head 3, the whip-lash movements of the nozzle head are enhanced. The cyclic mechanical and hydraulic loading of the treated material is improved thereby.

The device may be used not only for cutting and/or drilling rock 15 in open quarries but it may also be used in underground mines such as in salt deposits for recovering salt or in coal seams for crushing coal or even for enlarging the lodes so as to improve access to inaccessible seams. It is also possible to perform tunnel driving, for example for underground traffic routes. Also, the device can be used for cleaning landing strips, walls and the like, for removing road marking paints, for cleaning oil tanks or power plant tanks, or even for cleaning ships' sides below the waterline, i.e. removing shells, barnacles etc., and for road surface roughening. This offers further possible applications to the skilled man.

We claim:

1. A device for cutting, drilling or similar working of materials, such as rock, ores, natural stone, or concrete by means of a pressure medium, in which said pressure medium is supplied via a supply pipe to a nozzle head and is directed through at least one nozzle thereof in the form of a jet at a traversing angle onto said material, and in which a drive mechanism drives the nozzle head to produce an oscillatory motion substantially transversely to the direction of the jet, characterized in that the supply pipe comprises a rocking pipe (30) which causes the oscillatory motion of the nozzle head (3) and which is engaged by said drive mechanism (32, 33) which is supported by a control pipe (31) extending substantially parallel to said rocking pipe (30), said control pipe conducting the energy carrier to the drive mechanism (32) for actuating the same and including guide means (6) for the rocking pipe (30).

2. Device as claimed in claim 1, characterized in that the nozzle head (3) is provided with at least two nozzles (5*a*) and is pivotally mounted on an eccentric member functioning as drive mechanism (32), said eccentric member moving the nozzle head (3) in a plane substantially normal to the axis of the rocking pipe along a substantially circular or oval path.

3. Device as claimed in claim 1 or claim 2, characterized in that the nozzle head (3) is disposed on the free end of the rocking pipe (30), which is a pliable high-pressure hose and comprises elastomeric material and will expand under the action of internal pressure.

4. Device as claimed in any one of the preceding claims, characterized in that the eccentric member is mounted on the end of the control pipe (31) and that the energy carrier is a shaft (102) which transfers the kinetic energy, which is produced by a motor (101) mounted at the other end of the control pipe (31), to the eccentric member in the form of a rotary movement.

5. Device as claimed in claim 4, characterized in that a rigid supply pipe (12) leading to the high-pressure hose (30) is connected via connecting webs (36) to the control pipe (31) to form a substantially elongated and flat assembly therewith.

6. Device as claimed in any one of the preceding claims, characterized in that the part of the high-pressure hose-type rocking pipe (30) adjacent the nozzle head (3) is guided in a U-shaped guide member (6) having its respective legs (6*a*) joined to the control pipe (31) and/or a retaining member (100), said U-shaped guide member enclosing the sides of the nozzle head (3) or the adjacent portion of the rocking pipe (30) in spaced relationship.

7. Device as claimed in any one of the preceding claims, characterized in that a fitting (100) is mounted on the control pipe (31) to project beyond the nozzle head (3) in longitudinal direction (LR) of the device.

8. Device as claimed in any one of the preceding claims, characterized in that the inner diameter of the high-pressure hose-type rocking pipe (30) is selected to be considerably larger than the inner diameter of the substantially rigid supply pipe (12).

9. Device as claimed in any one of the preceding claims, characterized in that the high-pressure hose (30) is configured, arranged and dimensioned such that it performs a wave-like inherent deformation when the nozzle head (3) is driven via the eccentric member, and that the nozzle head (3) is mounted so that its movement can be controlled not only by the eccentric member but also by the wave-like inherent deformation of the high-pressure hose (30).

10. Device as claimed in any one of the preceding claims, characterized in that the nozzle head (3) is adapted to be detachably threaded or pushed onto a union member (1*c*) which is drivingly connected to the eccentric member via a coupling element (103).

11. Device as claimed in any one of the preceding claims, characterized in that the nozzle head (3) is provided with a central nozzle (5*a*) and at least a pair of side nozzles (5*a*), each of said side nozzles producing a lateral jet ($5b_1$,$5b_3$) which is offset with respect to the central jet ($5b_2$) exiting from the central nozzle (5*a*) and is inclined at a setting angle $\beta$ relative to the direction of the central jet.

12. Device as claimed in claim 11, characterized in that the setting angle $\beta$ is about 15° to 30°.

13. A device for cutting, drilling or similar working of rock, ores, natural stone or, concrete, with a pressure medium and including a supply pipe for said pressure medium having a rocking pipe supported thereon with a nozzle head carried on a free end of said rocking pipe, support and control means adjacent said supply pipe, and a drive mechanism interposed between said support and control means and said rocking pipe with actuating means carried by said support and control means for driving said drive mechanism to produce an oscillatory motion to said nozzle head with guide means on said support and control means for confining motion of said nozzle head.

14. A device as defined in claim 13, in which said nozzle head has at least two nozzles and said drive mechanism includes an eccentric member operatively connected to said nozzle head for moving the nozzle head in a plane substantially normal to the axis of the rocking pipe along a substantially circular or oval path.

15. A device as defined in claim 13, in which said rocking pipe is a pliable high-pressure hose of elastomeric material expandable under the action of internal pressure with said nozzle head disposed on a free end of said hose.

16. A device as defined in claim 15, in which said support and control means includes a hollow control pipe with said eccentric member mounted on a free end of said control pipe and in which said actuating means includes a shaft extending through said control pipe for transferring kinetic energy from a power source to said eccentric member in the form of a rotary movement.

17. A device as defined in claim 16, in which said supply pipe is rigid and further including connecting webs connecting said supply pipe to said control pipe to form a substantially elongated and flat assembly therewith.

18. A device as defined in any one of claims 13–17, in which said guide means includes a U-shaped guide member having respective legs extending from said support and control means, said U-shaped guide member guiding said rocking pipe along a path transverse to an axis of said supply pipe.

19. A device as defined in any one of claims 13–17, in which said support and control means includes a hollow pipe having a fitting mounted thereon and projecting beyond said nozzle head in a longitudinal direction.

20. A device as claimed in claim 19, in which an inner diameter of the high-pressure hose-type rocking pipe (30) is selected to be considerably larger than the inner diameter of the substantially rigid supply pipe (12).

21. A device as claimed in claim 20, in which said high-pressure hose (30) is configured, arranged and dimensioned such that is performs a wave-like inherent deformation when the nozzle head is driven via the eccentric member, and that the nozzle head is mounted so that its movement can be controlled not only by the eccentric member but also by the wave-like inherent deformation of the high-pressure hose.

22. A device as claimed in any one of claims 14–17, and in which the nozzle head is adapted to be detachably threaded or pushed onto a union member which is drivingly connected to the eccentric member via a coupling element.

23. A device as claimed in any one of claims 13–17, in which said nozzle head includes a central nozzle and at least a pair of side nozzles, each of said side nozzles producing a lateral jet which is offset with respect to the central jet exiting from the central nozzle and is inclined at a setting angle relative to the direction of the central jet.

24. A device as claimed in claim 23, in which said setting angle is about 15° to about 30°.

* * * * *

UNITED STATES PATENT AND TRADEMARK OFFICE

CERTIFICATE OF CORRECTION

PATENT NO. : 4,960,176

DATED : October 2, 1990

INVENTOR(S) : Loegel et al.

It is certified that error appears in the above-identified patent and that said Letters Patent is hereby corrected as shown below:

Column 1, Line 21, delete "had" and insert --head--.

Column 1, Line 32, delete "system" and insert --systems--.

Column 3, Line 36, delete "II-IIA" and insert --II-II--.

Column 3, Line 39, delete "and" and insert --;--.

Column 4, Line 20, delete "21" and insert --31--.

Column 5, Line 7, delete "traversely" and insert --transversely--.

Column 5, Line 29, after "chamber" insert --7--.

Column 5, Line 35, after "sapphire" insert --,--.

Column 5, Line 45, after "from" insert --the--.

Column 6, Line 18, delete "high pressure" and insert --high-pressure--.

Column 6, Line 29, after "4" insert --,--.

Column 6, Line 32, after "sleeves" insert --1a--.

Column 6, Line 34, after "angles" insert --β--.

Column 7, Line 11, after "31" insert --,--.

Column 9, Line 26, delete "11i a" and insert --11a--.

UNITED STATES PATENT AND TRADEMARK OFFICE

CERTIFICATE OF CORRECTION

PATENT NO. : 4,960,176

DATED : October 2, 1990

INVENTOR(S) : Loegel et al

It is certified that error appears in the above-identified patent and that said Letters Patent is hereby corrected as shown below:

Column 11, Claim 13, Line 4, delete "stone or, concrete," and insert --stone, or concrete,--.

Signed and Sealed this

Third Day of March, 1992

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,960,176

DATED : October 2, 1990

INVENTOR(S) : Charles Loegel et al.

It is certified that error appears in the above-identified patent and that said Letters Patent is hereby corrected as shown below:

Column 10, lines 16-17, Claim 4, delete "any one of the preceding claims" and insert --Claim 1--.

Column 10, lines 28-29, Claim 6, delete "any one of the preceding claims" and insert --Claim 1--.

Column 10, lines 37-38, Claim 7, delete "any one of the preceding claims" and insert --Claim 1--.

Column 10, lines 41-42, Claim 8, delete "any one of the preceding claims" and insert --Claim 1--.

Column 10, lines 46-47, Claim 9, delete "any one of the preceding claims" and insert --Claim 1--.

Column 10, lines 56-57, Claim 10, delete "any one of the preceding claims" and insert --Claim 1--.

Column 10, lines 61-62, Claim 11, delete "any one of the preceding claims" and insert --Claim 1--.

Column 12, line 9, Claim 19, delete "any one of Claims 13-17" and insert --Claim 13--.

UNITED STATES PATENT AND TRADEMARK OFFICE

CERTIFICATE OF CORRECTION

PATENT NO. : 4,960,176

DATED : October 2, 1990

INVENTOR(S) : Charles Loegel et al.

It is certified that error appears in the above-identified patent and that said Letters Patent is hereby corrected as shown below:

Column 12, line 25, Claim 22, delete "any one of Claims 14-17" and insert --Claim 15--.

Column 12, line 30, Claim 23, delete "any one of Claims 13-17" and insert --Claim 22--.

Signed and Sealed this

Sixth Day of October, 1992

*Attest:*

DOUGLAS B. COMER

*Attesting Officer*

*Acting Commissioner of Patents and Trademarks*